US006322412B2

(12) United States Patent
Viale

(10) Patent No.: US 6,322,412 B2
(45) Date of Patent: Nov. 27, 2001

(54) SWIMMING FLIPPER WITH INTERCHANGEABLE BLADE

(75) Inventor: Mario Viale, Chiavari (IT)

(73) Assignee: HTM Sport S.p.A. (IT)

( * ) Notice: Subject to any disclaimer, the term of this patent is extended or adjusted under 35 U.S.C. 154(b) by 0 days.

(21) Appl. No.: 09/790,883

(22) Filed: Feb. 23, 2001

(30) Foreign Application Priority Data

Feb. 25, 2000 (IT) ..... GE00A0026

(51) Int. Cl.[7] ..... A63B 31/08
(52) U.S. Cl. ..... 441/64; 441/61
(58) Field of Search ..... 441/61–64

(56) References Cited

U.S. PATENT DOCUMENTS

| | | | |
|---|---|---|---|
| 3,178,738 | | 4/1965 | Trell . |
| 3,302,222 | | 2/1967 | Ferraro . |
| 3,521,312 | | 7/1970 | Ganev . |
| 3,922,741 | * | 12/1975 | Semeia ..... 441/64 |

FOREIGN PATENT DOCUMENTS

| | | | |
|---|---|---|---|
| 669779 | | 3/1966 | (BE) . |
| 1 075 997 | | 2/1960 | (DE) . |
| 0310 828 | | 4/1989 | (EP) . |
| 208 636 | | 2/1960 | (FR) . |
| 2 410 488 | | 6/1979 | (FR) . |
| 2 543 004 | | 9/1984 | (FR) . |
| 2611509 | * | 9/1988 | (FR) ..... 441/64 |

* cited by examiner

*Primary Examiner*—Jesus D. Sotelo
(74) *Attorney, Agent, or Firm*—Larson & Taylor, PLC

(57) ABSTRACT

Swimming flipper consisting of a footwear equipped with a sole, and of a blade placed in front of said sole; in said flipper the sole and the blade are secured one to the other by connecting means allowing said blade to be removed from said sole and to be replaced with a similar blade or with any other type of blade.

17 Claims, 5 Drawing Sheets

SWIMMING FLIPPER WITH INTERCHANGEABLE BLADE

BACKGROUND AND SUMMARY OF THE INVENTION

The present invention relates to swimming flippers, and in particular to swimming flippers substantially consisting of a blade and a footwear or shoe suitably shaped and provided with a sole.

It is known about the existence of flippers provided with coupling systems which allow to secure a blade to the corresponding shoe or footwear, thus allowing its removal in situations in which, for instance, said blade is cumbersome before or after a diving session, or if it is damaged and needs to be replaced. Said systems are often quite complex and do not show a great efficiency; moreover, they allow to mount onto a given shoe only a given type of blade, according to the kind of diving the scuba diver might want to do with said blade, for instance skin diving or scuba diving or the like.

The present invention aims to provide a swimming flipper whose shoe portion can be connected to any kind of blade portion, whose width and/or length and material are chosen according to the type of diving the scuba diver might want to do.

Said scope is achieved by the present invention by means of a swimming flipper comprising a shoe portion equipped with a sole, and a blade portion placed before said sole; in said flipper the sole and the blade are attached one to the other by connecting means allowing the blade to be removed from the sole and to be replaced with a similar blade or with any other type of blade.

By means of the present swimming flipper provided with said connecting means, therefore, it is advantageously possible to adapt any type of blade, according to the various diving needs of the scuba diver, to the flipper shoe.

BRIEF DESCRIPTION OF THE DRAWINGS

Further aims and advantages of the present invention will be better understood through the following description, regarded as a mere non-limiting example, with reference to the enclosed drawings, in which.

DESCRIPTION OF THE PREFERRED EMBODIMENTS OF THE INVENTION

Figure 1:
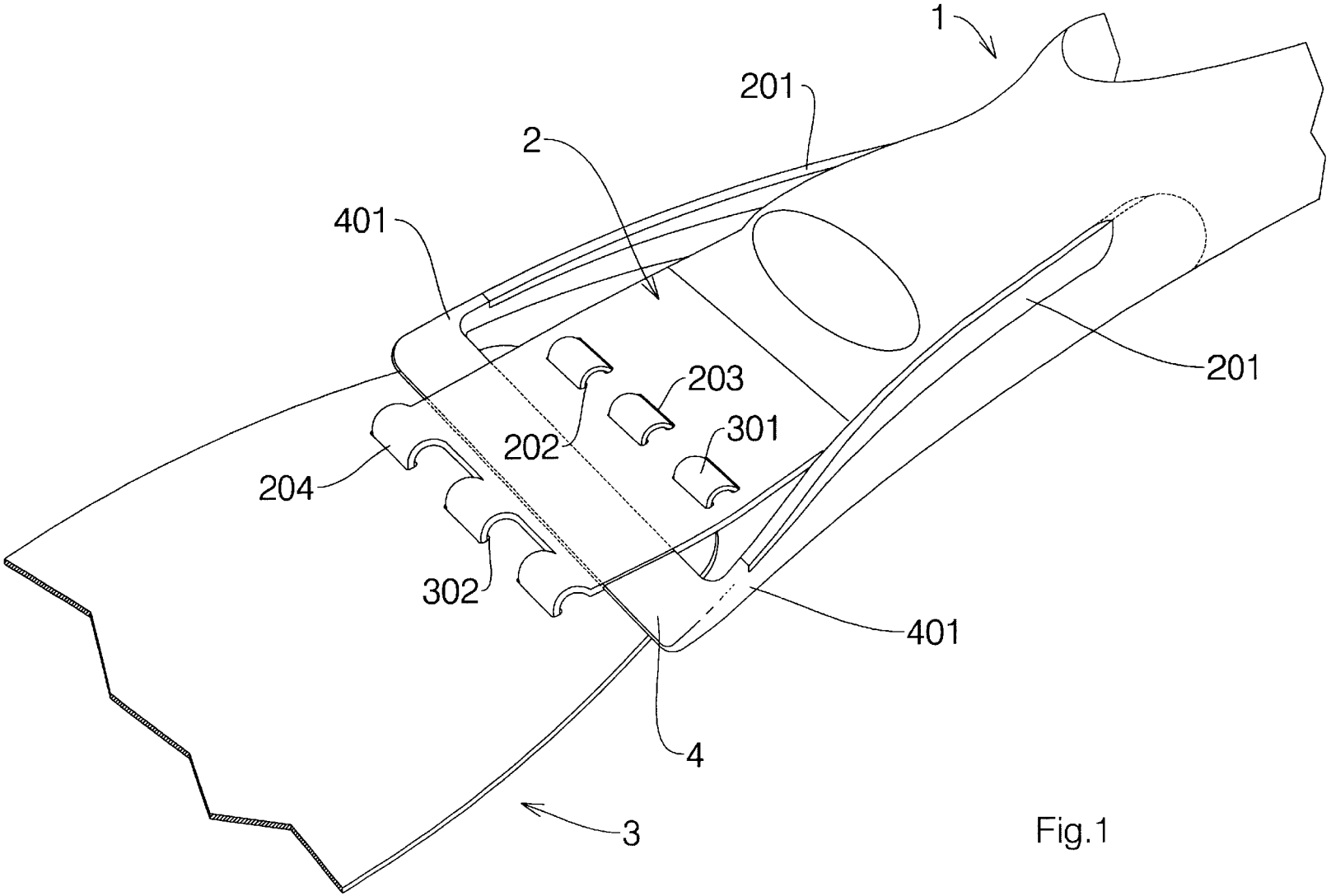
FIG. 1 shows a partial perspective view from above of a first form of embodiment of a swimming flipper with interchangeable blade according to the present invention.

With reference to FIG. 1, the latter shows a first form of embodiment of a swimming flipper according to the present invention, consisting of a footwear or shoe 1 made of a relatively soft material, for instance an elastomeric material such as rubber, and provided in its lower portion with a sole

2 made of a stiffer material, for instance a thermoplastic material with high mechanical resistance. The sole 2 laterally presents two reinforcing protruding elements 201, which form a substantially U-shaped opening from which the front portion of said sole 2 protrudes. Said surface of said inside portion of the sole 2 is connected to a blade 3, comprising, in its back portion, three protruding strips 301, two lateral strips and a central one. Said strips 301 are shaped so as to be introduced into first slots 202 obtained on the surface of the sole 2, which is partially placed above said blade 3 and abuts onto; the strips 301 come out of said first slots 202 and their free end is folded and introduced into second slots 203 obtained onto the sole 2 so as to be lined up longitudinally with respect to the first slots 202 and behind them. The front end of the sole 2 consists of three protruding strips 204, two lateral strips obtained from the rims of said sole 2, and a central one. The free ends of said strips 204 are folded and introduced into three slots 302 obtained on the surface of the blade 3. In order to allow the flipper a certain flexibility and elasticity in its movements during the diving session, it is provided for the mounting of a connecting rod 4, introduced into an opening 205 (which can be better seen in FIG. 2), obtained transversally with respect to the sole 2 on the lower surface in touch with the blade 3 below. Said connecting rod 4 is made of elastomeric material, such as rubber for instance, and it is laterally and longitudinally extended by means of extensible elements 401, which are connected to the protruding elements 201 for the reinforcement of the sole 2. According to an aspect of the present invention, the transversal connecting rod 4 and the lateral extensible elements 401 are made of the same material as the shoe 1, partially covering also the reinforcing protruding elements 201, for instance by injection of the elastomeric material of the shoe 1 into suitable molds.

Figure 2:
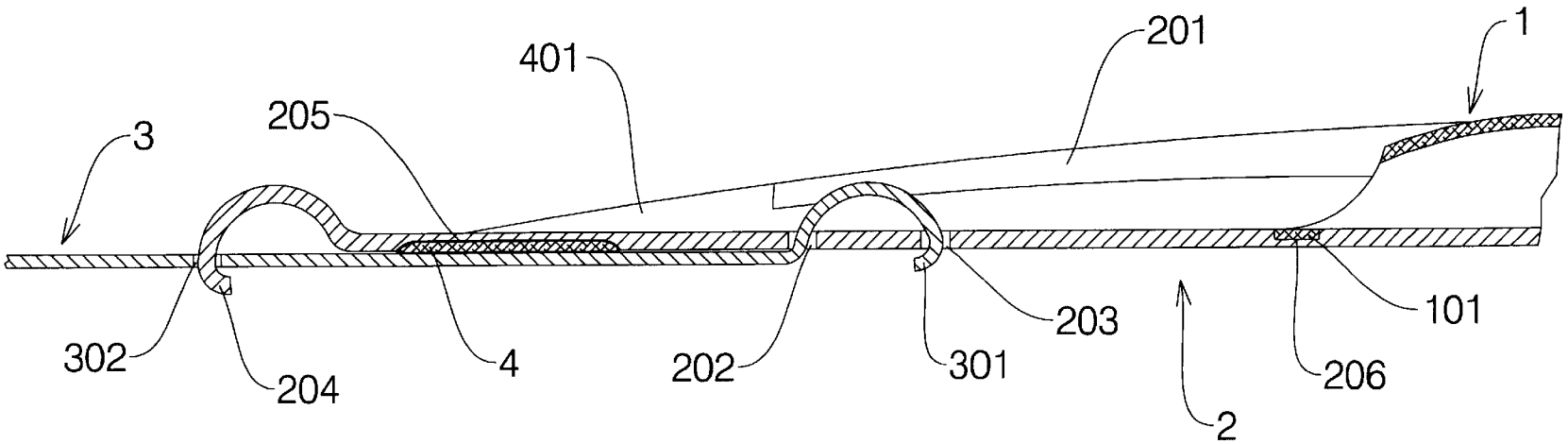
FIG. 2 shows a partial lateral and section view of the swimming flipper of FIG. 1.

In FIG. 2 it is possible to observe a lateral section view of the flipper in FIG. 1. As mentioned with reference to the previous figure, the connecting rod 4 is introduced into the opening 205 obtained under the surface of the sole 2, which, near the shoe base shows a weakening transversal portion 206, obtained from its upper surface and filled up with a layer 101 of elastomeric material, advantageously injected together with the material of the shoe 1. The use of the transversal connecting rod 4, fixed only to the lateral extensible elements 401, gives, as previously mentioned, a certain degree of elasticity and flexibility to the flipper in its movements during the diving session, allowing at the same time the blade 3 to be free from any permanent fixing to the sole 2, and, if the diver wants to remove said blade 3 from said sole 2, he/she just has to take out the strips 301 from the slots 203 and 202 and the strips 204 of the sole 2 from the corresponding slots 302 of the blade 3.

Figure 3:
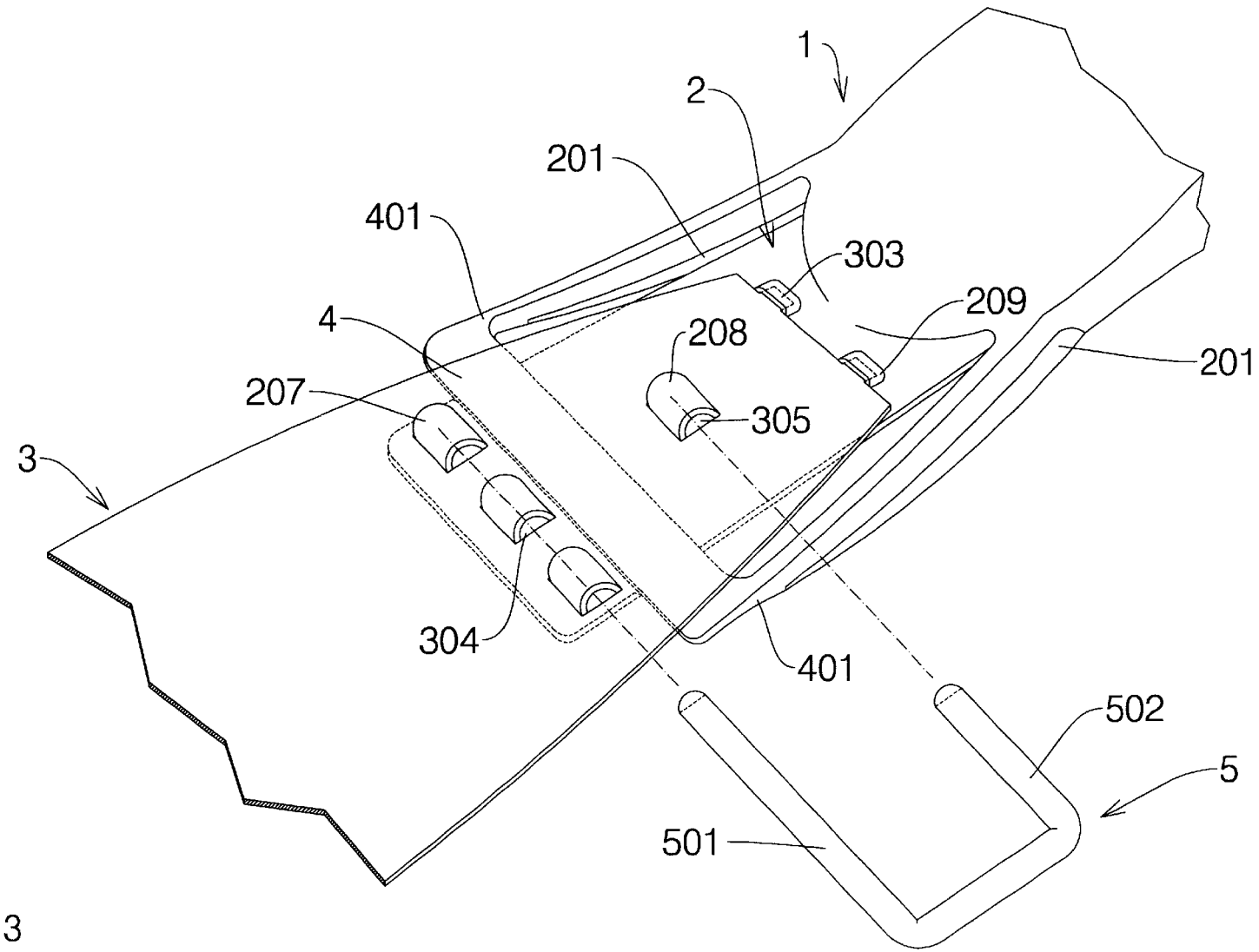
FIG. 3 shows a partial perspective view from below of a second form of embodiment of the swimming flipper according to the present invention.

FIG. 3 shows a second form of embodiment of the present swimming flipper seen from below. The sole 2 comprises, near its front rim, three strips 207 protruding below and transversally lined up one with respect to the other. Said protruding strips 207, once the flipper has been mounted, are placed before the connecting rod 4. Moreover, the sole 2 consists of a fourth strip 208, protruding below and obtained in an area which, once the blade 3 has been put onto said sole 2, is located near the back rim of said blade 3, therefore behind the transversal connecting rod 4. Said strips 207 and 208, protruding below in the present form of embodiment, are obtained integrally by a suitable shaping of the material of the sole 2, but they could also be fixed later to the lower surface of said sole 2. As can be observed from the figure, the four strips 207 and 208, when the sole 2 and the blade 3 overlap, are introduced into four corresponding holes obtained on the surface of said blade, and precisely three holes 304, transversally lined up, and a hole 305. On the back rim of the blade, moreover, two protruding elements 303 are obtained, said elements fitting into two corresponding housings 209 obtained on the sole 2 and protruding below. The four strips 207 and 208 cooperate, during the mounting of the flipper, with a fork 5, substantially U-shaped, whose two stems 501 and 502 respectively fit into the three strips 207 and the strip 208.

Figure 4:
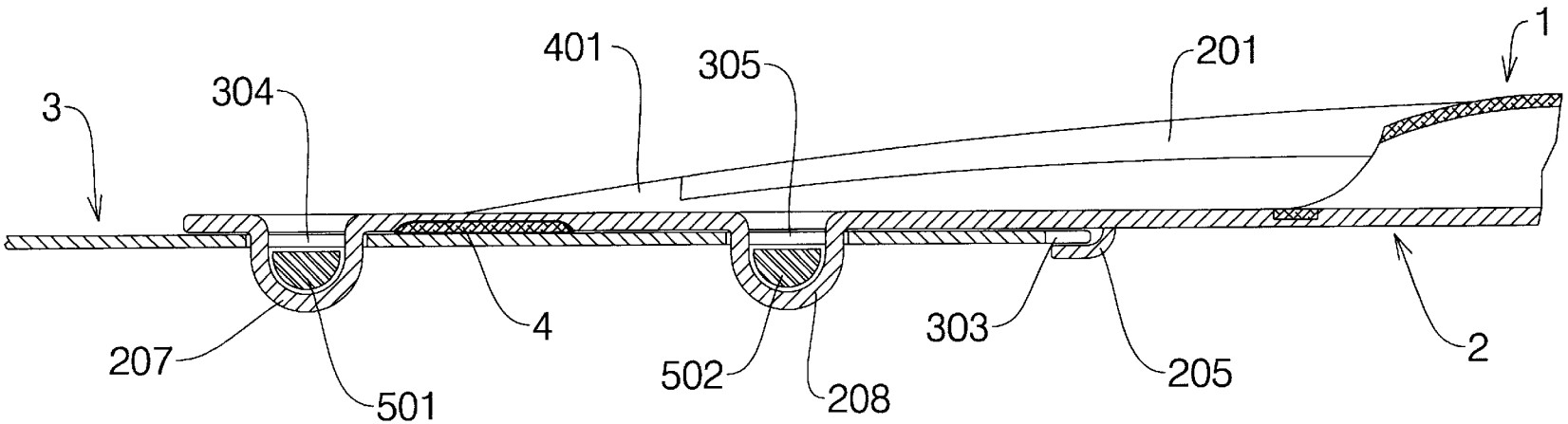
FIG. 4 shows a partial lateral and section view of the swimming flipper of FIG. 3.

In FIG. 4 it is possible to observe better the aspect of the flipper after its mounting. After introducing the two protruding elements 303 into the corresponding housings 205, the overlapping of the sole 2 and the blade 3 is completed by introducing the strips 207 and 208 into the corresponding holes 304 and 305, and by eventually introducing the stems 501 and 502 of the fork 5 into said strips, respectively strips 207 and 208. Observe by the way the suitable semicircle shape of the transversal section of said stems of the fork 5.

Figure 5:
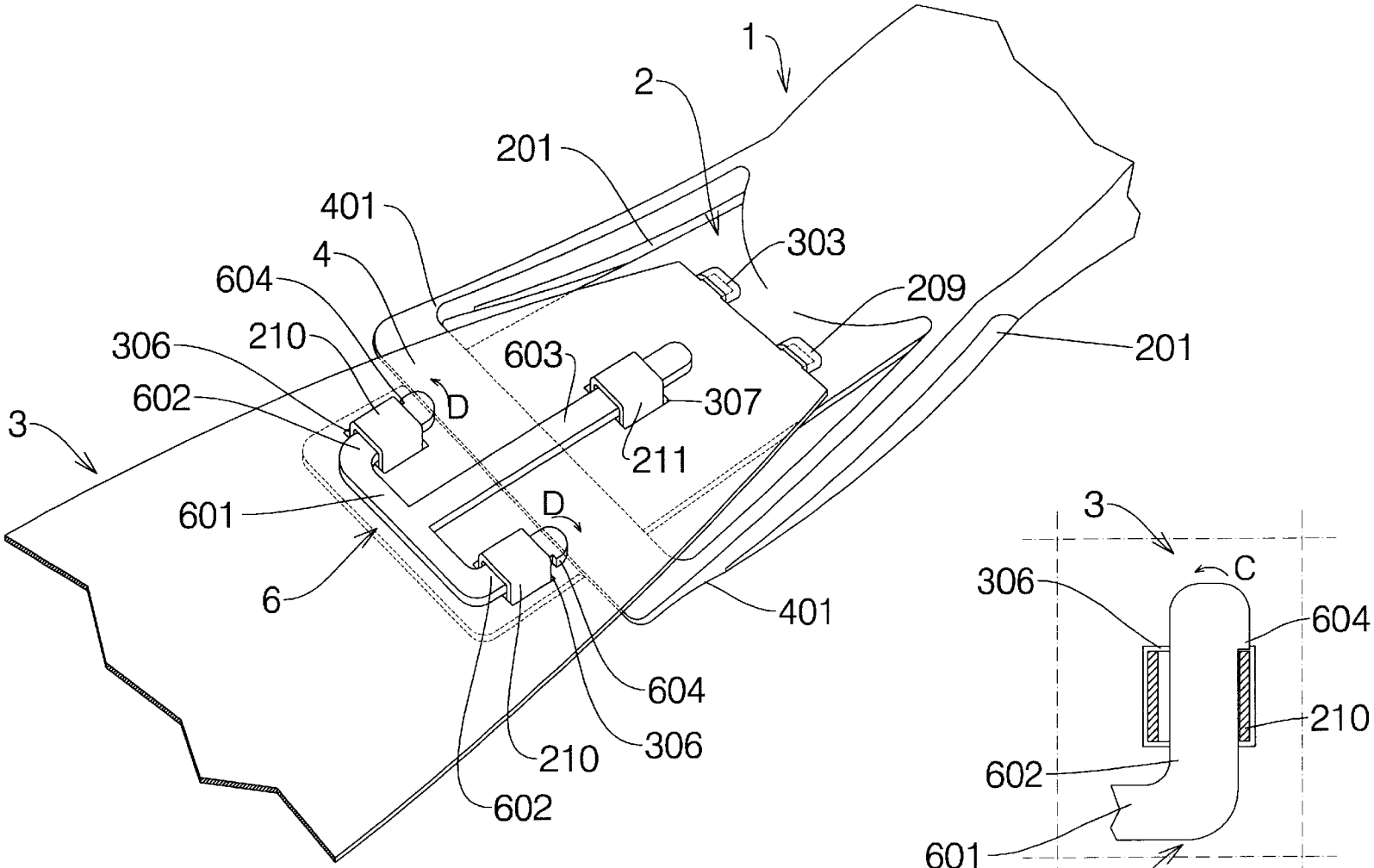
FIG. 5 shows a partial perspective view from below of another embodiment of the fin according to the invention.

In FIG. 5 an embodiment of the present fin is shown from below. The sole 2 comprises, near its front rim two strips 210 protruding below from said sole and aligned transversely one with respect to the other. The said strips 210 have their apertures directed in longitudinal direction with respect to the sole 2 and the blade 3 and, once completed the assembling of the fin, they are positioned before the connecting rod 4. The sole 2 is further provided with a third projecting strip 211 formed in a zone which, once the blade 3 has been superposed to said sole 2, is disposed near the back rim of the blade 3, and therefore backwards with respect to the connecting rod. Also this third strip 211 has its aperture directed in longitudinal direction with respect to the sole 2 and the blade 3. The three strips 210 and 211 are, according to the present embodiment, made integral with the sole 2, but they could also be secured in any other suitable manner to the lower surface of the sole 2. As shown, whenever the sole 2 is superposed on the blade 3, the three strips 210 and 211 are inserted in three holes made in the blade 3, that is two holes 306 transversally alligned, and one hole 307. In a manner similar to that of the embodiment of FIG. 3, the blade 3 is provided with two projecting members 303 which may be inserted in two corresponding housings 209 formed in the sole 2 and projecting from below.

Figure 6:
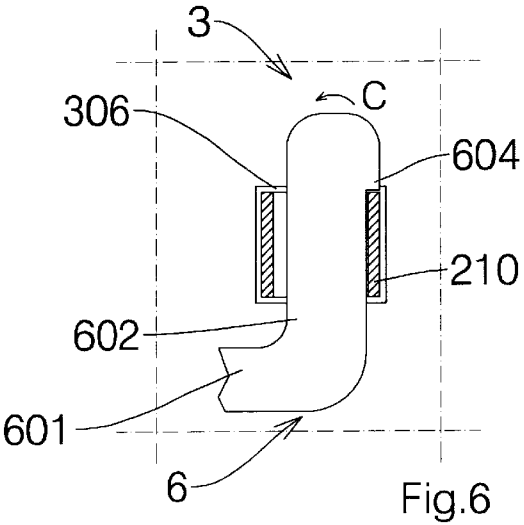
FIG. 6 is e view from below of a detail of the embodiment of FIG. 5.

The three strips 210 and 211, during the assembling of the fin, cooperates with an anchor-shaped member 6 comprising a base 601 from which the two side arms 602 and the central leg 603, which is longer than the said arms 602, are extending. The ends of the side arms 602 are rounded and are sidewise provided with two teeths 604 projecting toward the sides of the fin. By assembling of the fin, the central leg 603 is inserted from below in the strip 211. During this operation, the side arms 602 are slightly urged the one toward the other and are inserted in the corresponding strips 210. As soon as their insertion is completed, the arms are elastically returned to their original configuration (direction of arrows D in FIG. 5) so that the teeths 604 are brought into abutment against the walls of the strips 210. In this regard, attention is directed to FIG. 6 in which, by way of example, the right side arm is shown: As it may be noted, the tooth 604 and the external wall of the arm 602 are into contact with the external wall of the strip 210. Thanks to the abutment of the said tooth 604, the element 6 cannot be inadvertently shifted longitudinally in a direction in which the blade 3 could be disconnected from the sole 2. In order to disassemble the blade 3 from the sole 2 it is sufficient to again compress the two arms 604 the one toward the other (direction of arrow C in FIG. 5) thus allowing the extraction of the arms out of the strips 210, and thus the extraction of the anchor-like element 6.

As an alternative to the connecting means described in the two previous forms of embodiment of FIGS. 1, 2, 3 and 4, it is possible to use other means allowing the removal of the blade from the flipper and its replacement with any other type of blade, for instance pins, fitting systems, screws, nuts or others, possibly combined one with the other and/or with the means described in the previous figures.

I claim:

1. Swimming flipper comprising a sole and a blade placed before said sole, wherein the sole and the blade partially overlap each other and are secured one to the other by connecting means which allow the blade to be removed from the sole and to be replaced with a different blade, said connecting means comprising one or more protruding strips on the front rim of the sole and shaped so as to be coupled to corresponding seats on the surface of the blade.

2. Swimming flipper according to claim 1, wherein said connecting means further comprises one or more protruding strips on the back rim of the blade and shaped so as to be coupled to corresponding seats on the surface of the sole.

3. Swimming flipper according to claim 2, wherein each of said strips is introduced into at least a pair of slots on the sole surface and lined up with respect to a longitudinal direction of the flipper.

4. Swimming flipper according to claim 1, wherein the said blade is mechanically connected to the said sole.

5. Swimming flipper according to claim 1, wherein the said blade is connected to the said sole by means of fitting elements.

6. Swimming flipper according to claim 1, wherein the said sole comprises, on its sides and front portion, at least two reinforcing protruding elements, equipped with corresponding elastic terminal elements, said terminal elements being connected one to the other by means of a transversal connecting rod integral with the said sole.

7. Swimming flipper according to claim 6, wherein said transversal connecting rod is located between the lower surface of the said sole and the upper surface of the said blade.

8. Swimming flipper according to claim 6, wherein said connecting rod is made of elastomeric material.

9. Swimming flipper according to claim 6, wherein said connecting rod is introduced into an opening obtained on the lower surface of the said sole.

10. Swimming flipper according to claim 6, wherein the said footwear is made of elastomeric material, and the said connecting rod and the said terminal elements are obtained by injection of the same elastomeric material from which the footwear is made.

11. Swimming flipper comprising a sole and a blade placed before said sole, wherein the sole and the blade partially overlap each other and are secured one to the other by connecting means which allow the blade to be removed from the sole and to be replaced with a different blade, wherein the said sole is provided on its front portion with at least a first strip, protruding with respect to the lower surface and introduced into at least a first hole obtained on the surface of the blade, and it is provided, in an area near the back rim of the blade, after the partial overlapping of said sole and said blade, with at least a second strip, protruding with respect to the lower surface and introduced into at least a second hole obtained on the surface of the blade, said first and second strips being crossed by a fork-shaped element apt to complete the connection of said sole to said blade.

12. Swimming flipper comprising a sole and a blade placed before said sole, wherein the sole and the blade partially overlap each other and are secured one to the other by connecting means which allow the blade to be removed from the sole and to be replaced with a different blade, wherein the said sole is provided at its forward end with at least one first strip projecting with respect to its lower surface and inserted in a first hole formed in the surface of the said blade, and is provided, in a zone close to the rear rim of the said blade when the said sole is partially superposed to said blade, of at least two strips projecting with respect to the lower surface of said sole and inserted in two holes formed on the surface of the said blade, an anchor-like element being provided having two arms and one leg which may be inserted respectively into said first strip and into the said two strips in order to assemble the blade to the sole, the said anchor-like member being further provided with means for securing it to the said sole.

13. Swimming flipper according to claim 12, wherein the said anchor-like member comprises a base from which two side arms are extending, which are apt to be inserted in said strips of the said sole, the said side arms being provided near their free end with at least one tooth which is apt to come into abutment with the walls of said strips.

14. Swimming flipper according to claim 12, wherein the said blade is provided on its back rim with one or more protruding members fitted into corresponding housings on the surface of the sole and protruding with respect to the latter.

15. Swimming flipper comprising a sole and a blade placed before said sole, wherein the sole and the blade partially overlap each other and are secured one to the other by connecting means which allow the blade to be removed from the sole and to be replaced with a different blade, said connecting means further comprising one or more protruding strips on the back rim of the blade and shaped so as to be coupled to corresponding seats on the surface of the sole.

16. Swimming flipper comprising a sole and a blade placed before said sole, wherein the sole and the blade partially overlap each other and are secured one to the other by connecting means which allow the blade to be removed from the sole and to be replaced with a different blade, said blade being provided on its back rim with one or more protruding members fitted into corresponding housing on the surface of the sole and protruding with respect to the latter.

17. Swimming flipper comprising a sole and a blade placed before said sole, wherein the sole and the blade are secured one to the other by connecting means which allow the blade to be removed from the sole and to be replaced with a different blade, said sole comprising, on its sides and front portion, at least two reinforcing protruding elements, equipped with corresponding elastic terminal elements, said terminal elements being connected one to the other by means of a transversal connecting rod integral with the sole.

* * * * *